US010161604B2

(12) United States Patent
Sorensen et al.

(10) Patent No.: US 10,161,604 B2
(45) Date of Patent: Dec. 25, 2018

(54) LED LIGHTING SYSTEM WITH CENTRALLY HELD LONGITUDINALLY EXTENDING LED LAMPS AND METHOD THEREOF

(71) Applicant: Litetronics International, Inc., Harvey, IL (US)

(72) Inventors: Robert Sorensen, Harvey, IL (US); Raghu Rao, Romeoville, IL (US)

(73) Assignee: Litetronics International Inc., Bedford Park, IL (US)

( * ) Notice: Subject to any disclaimer, the term of this patent is extended or adjusted under 35 U.S.C. 154(b) by 134 days.

(21) Appl. No.: 14/996,094

(22) Filed: Jan. 14, 2016

(65) Prior Publication Data

US 2016/0201883 A1 Jul. 14, 2016

Related U.S. Application Data

(60) Provisional application No. 62/103,099, filed on Jan. 14, 2015.

(51) Int. Cl.

| | |
|---|---|
| ***F21V 19/00*** | (2006.01) |
| ***F21V 23/06*** | (2006.01) |
| ***G09F 13/22*** | (2006.01) |
| ***G09F 13/04*** | (2006.01) |
| ***F21V 21/096*** | (2006.01) |
| ***F21V 23/00*** | (2015.01) |
| ***F21K 9/27*** | (2016.01) |
| ***F21V 21/35*** | (2006.01) |
| ***H01R 25/14*** | (2006.01) |
| ***H01R 13/625*** | (2006.01) |
| *F21Y 103/10* | (2016.01) |

(Continued)

(52) U.S. Cl.

CPC ..... *F21V 19/008* (2013.01); *F21K 9/27* (2016.08); *F21V 21/096* (2013.01); *F21V 21/35* (2013.01); *F21V 23/001* (2013.01); *F21V 23/06* (2013.01); *G09F 13/04* (2013.01); *G09F 13/22* (2013.01); *H01R 13/625* (2013.01); *H01R 25/14* (2013.01); *H01R 25/142* (2013.01); *F21Y 2103/10* (2016.08); *F21Y 2115/10* (2016.08); *G09F 2013/222* (2013.01); *H01R 33/94* (2013.01); *H01R 2103/00* (2013.01)

(58) Field of Classification Search

CPC ..... F21K 9/00; F21K 9/20; F21K 9/27; F21K 9/272; F21V 17/00; F21V 17/10; F21V 17/104; F21V 17/16; F21V 19/0075; F21V 19/008; F21V 21/35; H01R 25/14; F21Y 2103/00; F21Y 2103/10

USPC ..... 362/249.02, 311.02

See application file for complete search history.

(56) References Cited

U.S. PATENT DOCUMENTS

2008/0007957 A1* 1/2008 Satoh ..... F21V 19/0085 362/362

2010/0265700 A1* 10/2010 Galluccio ..... F21V 19/008 362/217.13

* cited by examiner

*Primary Examiner* — Sean Gramling

*Assistant Examiner* — Gerald J Sufleta, II

(74) *Attorney, Agent, or Firm* — Steve Witters; Witters & Associates

(57) ABSTRACT

An LED lighting system having at least one longitudinally extending LED lamp with a sole LED lamp holder on each of the at least one longitudinally extending LED lamps is presently disclosed. An LED lamp mount is configured to connect, and unconnect, with the LED lamp holder and hold and energize each of the at least one longitudinally extending LED lamps. The LED lamp mount is configured for (Continued)

mounting the LED lighting system. Also presently disclosed is a method for installing a lighting system.

18 Claims, 8 Drawing Sheets

(51) Int. Cl.

| | |
|---|---|
| *F21Y 115/10* | (2016.01) |
| *H01R 103/00* | (2006.01) |
| *H01R 33/94* | (2006.01) |

LED LIGHTING SYSTEM WITH CENTRALLY HELD LONGITUDINALLY EXTENDING LED LAMPS AND METHOD THEREOF

CROSS-REFERENCE TO RELATED APPLICATIONS

This application claims the benefit of U.S. Application No. 62/103,099, filed Jan. 14, 2015, entitled LED Lamp System, which is hereby incorporated by reference in its entirety.

FIELD OF THE DISCLOSURE

This invention generally relates to lighting systems, and, more particularly, to an LED lighting system.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Fluorescent light fixtures have typically been installed in a variety of applications. Typically, such fluorescent fixtures include florescent lamps with electrical connectors on each end with are connected with spaced apart lamp holders or sockets. A ballast is attached within the lamp and wiring attaches the ballast to the lamp holders. Power is supplied to the ballast by wiring brought into the light fixture. A ballast cover is used to cover the ballast and wiring. Linear, or longitudinally extending, fluorescent lamps are then placed in the lamp holders for operation of the fixture.

Since the introduction of the fluorescent lamp at the 1939 World Fair, fluorescent lighting technology has greatly advanced. For example, over the years, lamp and ballast manufacturers have developed fluorescent lamp-ballast systems with improved efficiencies. More recently, light emitting diode (LED) lamps have been developed. An LED lamp is a solid-state lamp that uses LEDs as the source of light. An LED may comprise a conventional semiconductor light emitting diode or an organic or polymeric light emitting diode. LED lamps may have one or more advantages over fluorescent lamps, for example, LED lamps do not contain mercury, they may turn on more instantaneously, they may have a longer service life, and they may have a greater efficiency.

It may be desired to provide advantages of LEDs to lighting systems.

SUMMARY

In at least one embodiment of the present disclosure, an LED lighting system having at least one longitudinally extending LED lamp with a sole LED lamp holder on each of the at least one longitudinally extending LED lamps is presently provided. An LED lamp mount is configured to connect, and unconnect, with the LED lamp holder and hold and energize each of the at least one longitudinally extending LED lamps. The LED lamp mount is configured for mounting the LED lighting system.

In at least one other embodiment of the present disclosure, a method for installing a lighting system comprising the steps of: installing an LED lamp mount proximate or with an item or area to be illuminated; and connecting a sole lamp holder to the LED lamp mount and holding a longitudinally extending LED lamp, having a length substantially greater than a width, therewith.

In at least one further embodiment of the present disclosure, an LED lighting system comprises at least one longitudinally extending LED lamp having a length substantially greater than a width, a sole LED lamp holder on each of the at least one longitudinally extending LED lamps, a longitudinally extending track LED lamp mount having a longitudinally extending slot, and a locking mechanism on the sole LED lamp holder configured to hold a portion of the LED lamp holder in the slot, upon a rotation of the LED lamp holder.

BRIEF DESCRIPTIONS OF THE DRAWINGS

The following figures, which are idealized, are not to scale and are intended to be merely illustrative of aspects of the present disclosure and non-limiting. In the drawings, like elements are depicted by like reference numerals. The drawings are briefly described as follows.

DETAILED DESCRIPTION

Reference will now be made in detail to the present exemplary embodiments and aspects of the present invention, examples of which are illustrated in the accompanying figures. The same reference numbers may be used in the figures to refer to the same or like parts. The presently disclosed embodiments, aspects, and features of the present invention are not to limit the presently claimed invention as other and different embodiments, aspects, and features will become apparent to one skilled in the art upon reading the present disclosure.

Figure 1:
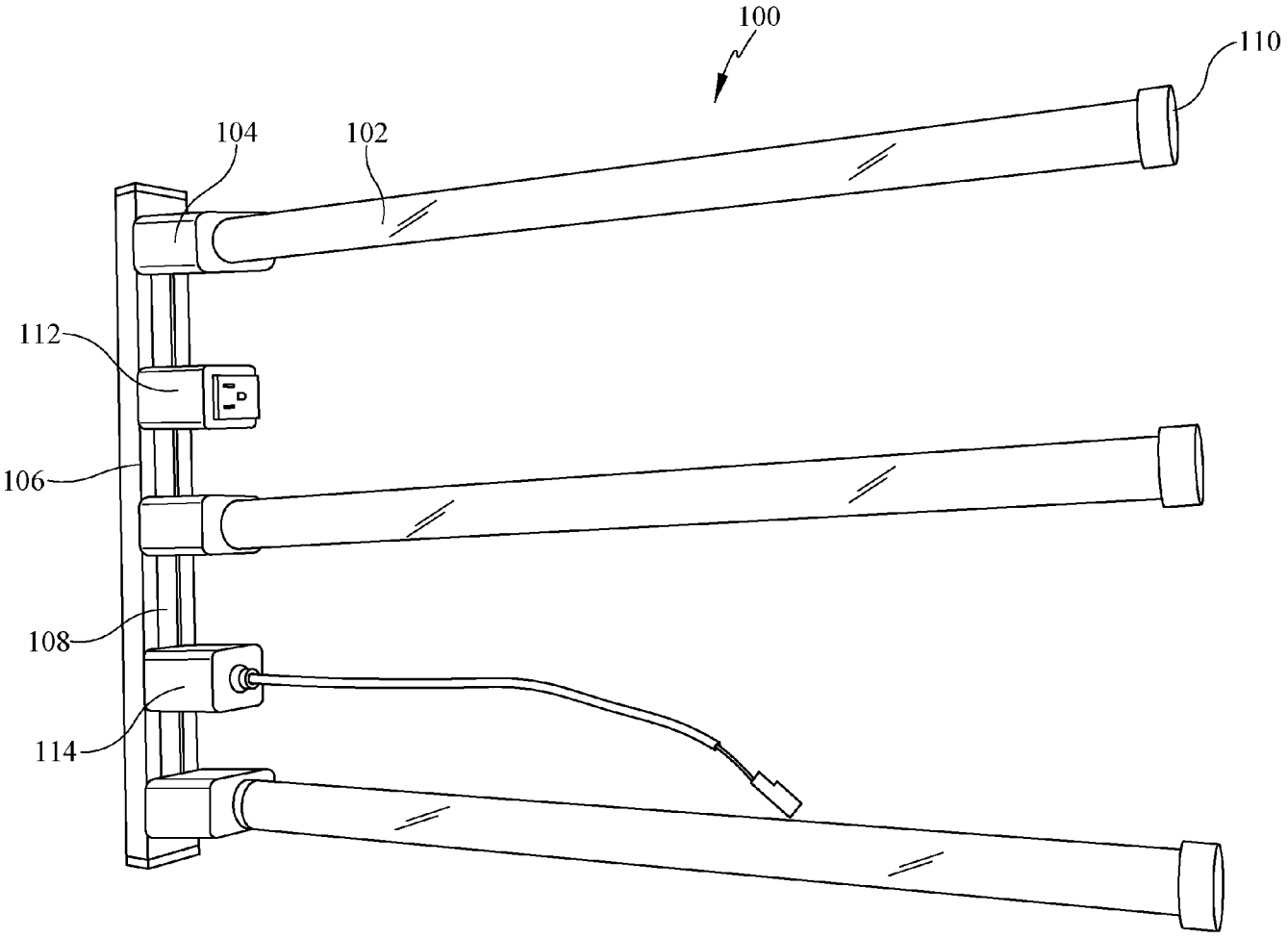
FIG. 1 is a perspective view of an LED lighting system of the present disclosure.

FIG. 1 shows LED lighting system 100 having a plurality of longitudinally extending LED lamps 102. Each longitudinally extending LED lamp 102 has a length substantially greater than a width. For example, LED lamp 102 may have a diameter in a range of about 0.5 inches to about 2.5 inches and a length of about 0.5 feet to about 10 feet, or longer. LED lamp 102 may have a T5, T8, T12, or other configuration. Longitudinally extending LED lamp 102 may have a length 5, 6, 7, or up to, and in excess of, 100 times greater than a width. In at least one embodiment, longitudinally extending LED lamp 102 has a length at least 20 times greater than a width. A sole LED lamp holder 104 is on each longitudinally extending LED lamp 102. For example, each sole LED lamp holder 104 extends from a longitudinal end of each longitudinally extending LED lamp 102. An LED lamp mount 106 is configured to connect, and unconnect, with each LED lamp holder 104. Upon connecting each longitudinally extending LED lamp 102 to LED lamp mount 106, LED lamp mount 106 may hold and energize each longitudinally extending LED lamp 102. LED lamp mount 106 is configured for mounting LED lighting system 100.

LED lamp mount 106 has a length substantially greater than a width. Each sole LED lamp holder 104 holds its longitudinally extending LED lamp 102 with its longitudinal axis substantially perpendicular with a longitudinal axis of LED lamp mount 106. For example, each longitudinally extending LED lamp 102 has an axial end mounted with LED lamp mount 106 and its whole length extending from LED lamp mount 106. An end cap 110 may be on the end of each longitudinally extending LED lamp 102, the end extending from LED lamp mount 106.

In the example of the LED lighting system of the present disclosure shown in FIG. 1, LED lamp mount 106 comprises a track with a slot 108 and each LED lamp holder 104 may slide within slot 108. Other electrical hardware may be held with LED lamp mount 106. For example, an electrical connector with a plug receptacle, 112, and/or an electrical connector 114 may be mounted with LED lamp mount 106. Electrical connector with a plug receptacle, 112, and/or electrical connector 114 may comprise a holder configured like sole LED lamp holder 104 and may be configured to connect with a power source for energizing each longitudinally extending LED lamp 102.

Figure 2:
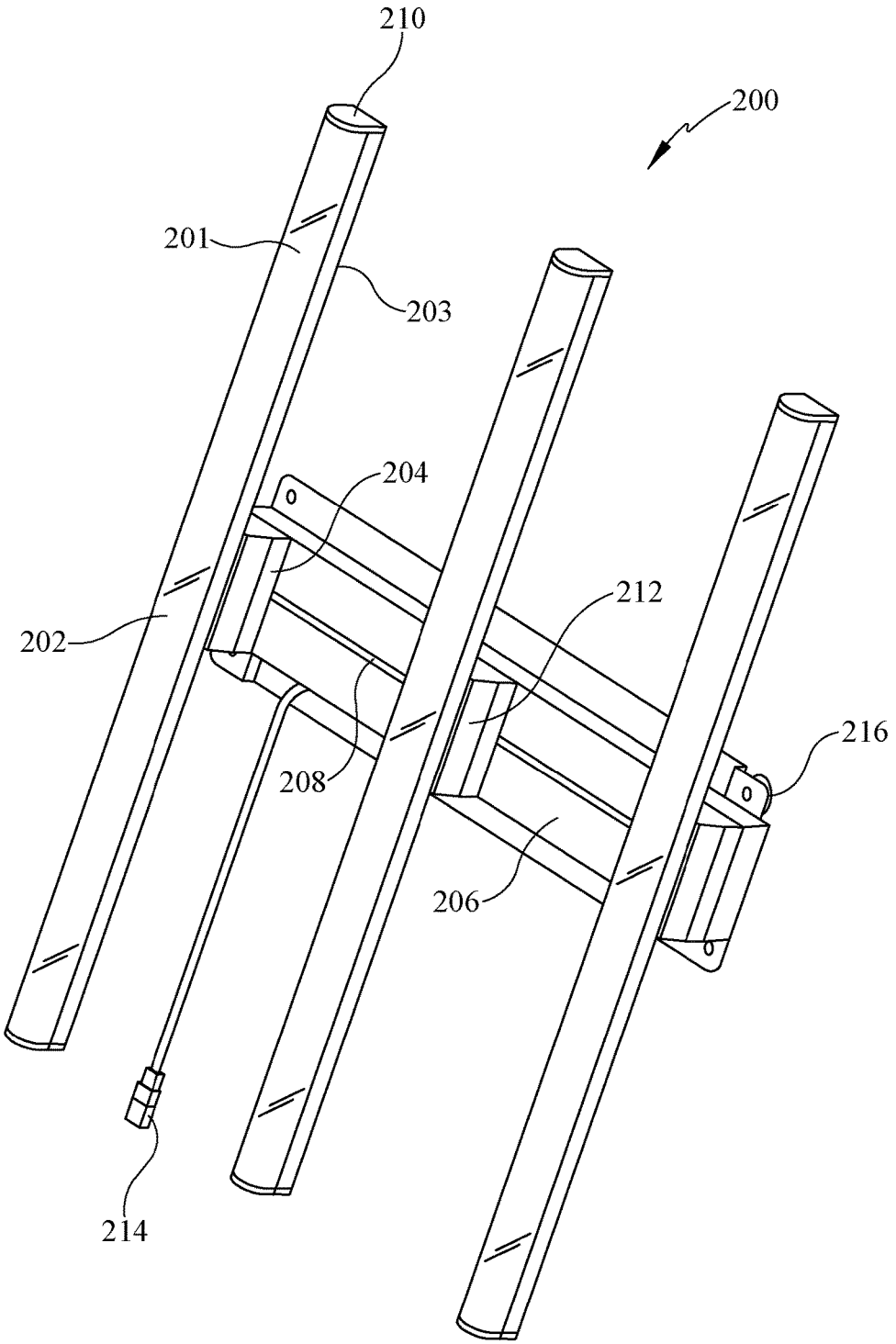
FIG. 2 is a perspective view of another embodiment of the LED lighting system of the present disclosure.

FIG. 2 shows LED lighting system 200 having a plurality of longitudinally extending LED lamps 202. Each longitudinally extending LED lamp 202 has a length substantially greater than a width. A sole LED lamp holder 204 is on each longitudinally extending LED lamp 202. For example, each sole LED lamp holder 204 extends from a central portion of each longitudinally extending LED lamp 202. An LED lamp mount 206 is configured to connect, and unconnect, with each LED lamp holder 204. Upon connecting each longitudinally extending LED lamp 202 to LED lamp mount 206, LED lamp mount 206 holds and energizes each longitudinally extending LED lamp 202. LED lamp mount 206 is configured for mounting LED lighting system 200. For example, LED lamp mount 206 may comprise one or more magnets 216 configured and disposed to mount to a ferromagnetic material.

LED lamp mount 206 has a length substantially greater than a width. Each sole LED lamp holder 204 holds its longitudinally extending LED lamp 202 with its longitudinal axis substantially perpendicular with a longitudinal axis of LED lamp mount 206. For example, each longitudinally extending LED lamp 202 may have a base 212 configured to electrically connect and be held with its sole LED lamp holder 204. In this example of the lighting system of the present disclosure, an end cap 210 may be on each axial end of each longitudinally extending LED lamp 202. Each LED lamp 202 may comprise a diffuser 201 and a heat sink 203.

LED lamp mount 206 may comprise a track with a slot 208 and each LED lamp holder 204 may slide within slot 208. Other electrical hardware may be incorporated with LED lamp mount 206. For example, an electrical connector 214 may be configured to connect with a power source for energizing each longitudinally extending LED lamp 202.

Figure 3:
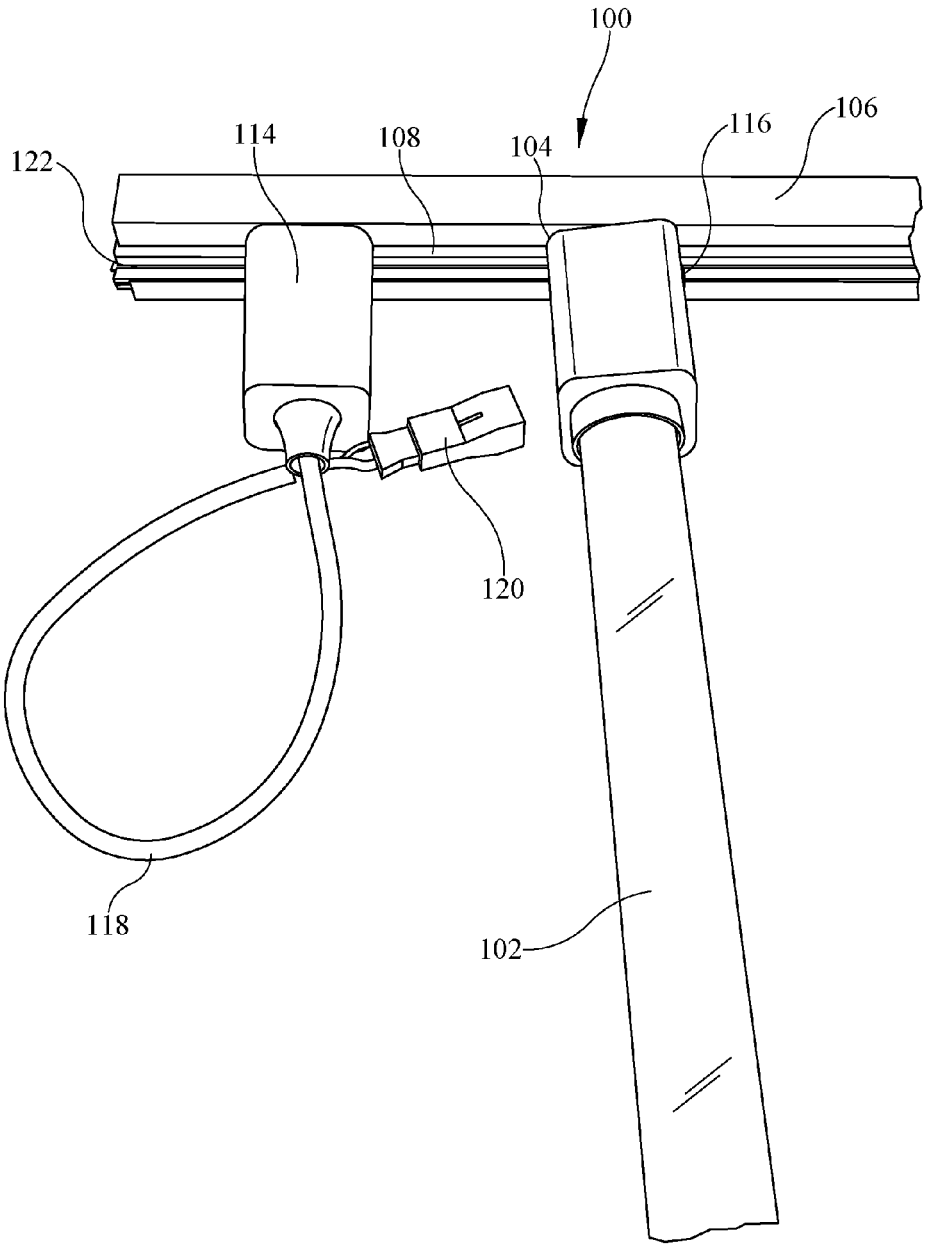
FIG. 3 is a view of a portion of the LED lighting system of FIG. 1 showing a sole LED lamp holder holding a longitudinally extending LED lamp with a LED lamp mount.

FIG. 3 shows a portion of LED lighting system 100 having a sole LED lamp holder 104 holding an LED lamp 102 with a LED lamp mount 106. LED lighting system 100 has LED lamp mount 106 in the form of a track with a slot 108. LED lamp holder 104 is configured to slide within slot 108 and have its axis substantially aligned with the longitudinal axis of longitudinally extending LED lamp 102. For example, LED lamp holder 104 may be configured to slide about the longitudinal axis of the track upon cooperation, and optionally electrical connection, with portions of track 106.

LED lamp holder 104 may comprise a locking device 116 having a portion received into slot 108, stopping a rotation of longitudinally extending lamp 100 in LED lamp mount, or track, 106. For example, a portion of sole LED lamp holder 104 may be inserted into slot 108 and, upon about a 90° rotation of LED lamp holder 104 in slot 108, a portion of locking device 116 may extend into slot 108 and stop the rotation of LED lamp holder 104 in slot 108.

Upon LED lamp holder 104 being inserted into 108 and rotated into a locking position, LED lamp holder 104 may be become in electrical communication with LED lamp mount 106. For example, LED lamp mount 106 may have one or more electrical contact strips 122 disposed therewith. In this example, an electrical contact between LED lamp holder 104 and longitudinal extending LED lamp 100 may be maintained upon sliding LED lamp holder 104 in slot 108.

Electrical connector 114 may comprise power lead wire 118 and quick connect 120, or other electrical connector. Electrical connector 114 may be configured to electrically connect with LED lamp holder 104, upon a 90° rotation thereof. The electrical connection may be maintained upon sliding electrical connector 114 in slot 108. In at least one embodiment of the present disclosure, electrical connector 114 is configured to connect LED lamp mount 106 to a power source and energize longitudinally extending lamp 100.

A portion of the locking device 116 may be received with slot 108 which may be a retractable extension biased toward slot 108. Locking device 116 may be configured to be retracted from the slot by hand and enable the rotation of LED lamp holder 104 in slot 108 and removal of longitudinally extending LED lamp 100 from LED lamp mount 106.

Figure 4:
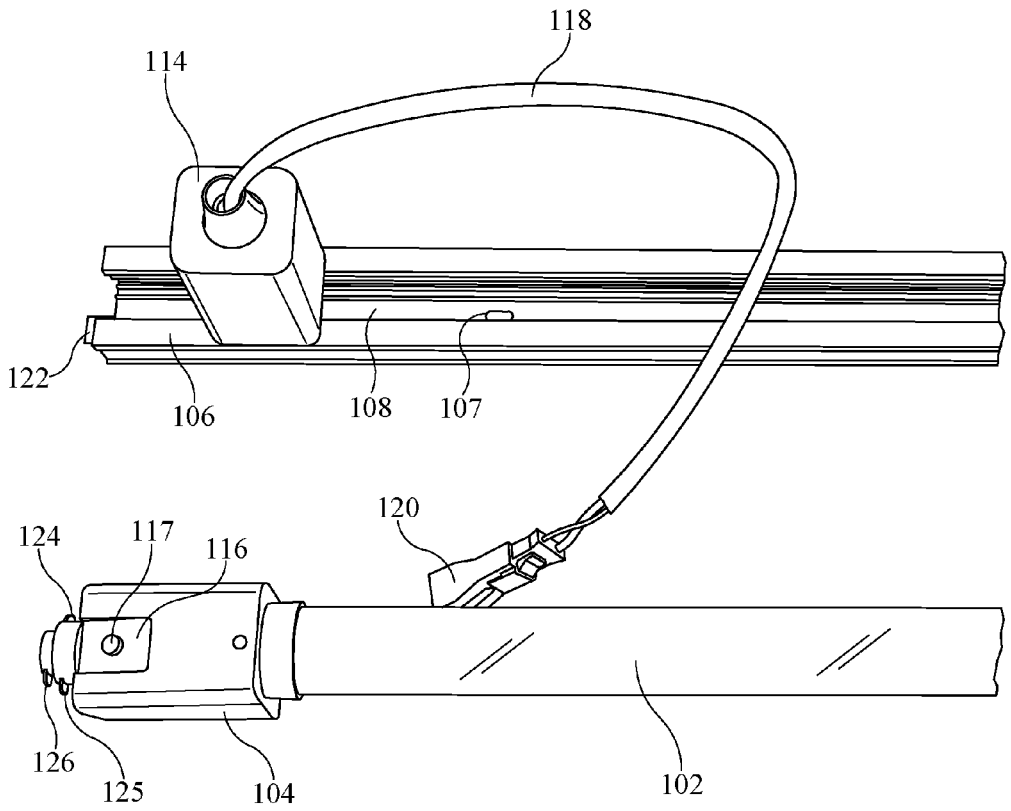
FIG. 4 is a view of a portion of the LED lighting system of FIG. 1 showing the longitudinally extending LED lamp removed from the LED lamp mount.
Figure 5:
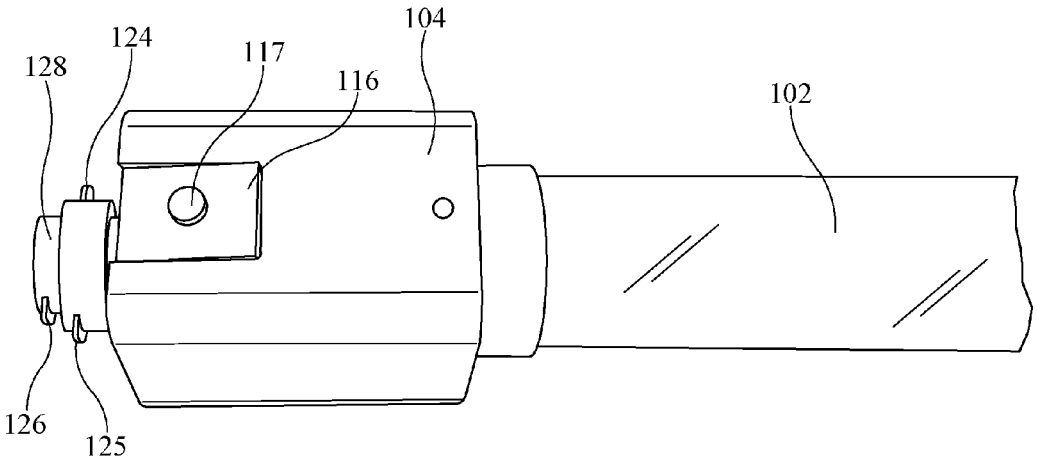
FIG. 5 is a view of a portion of the LED lighting system of FIG. 1 showing a sole LED lamp holder.
Figure 6:
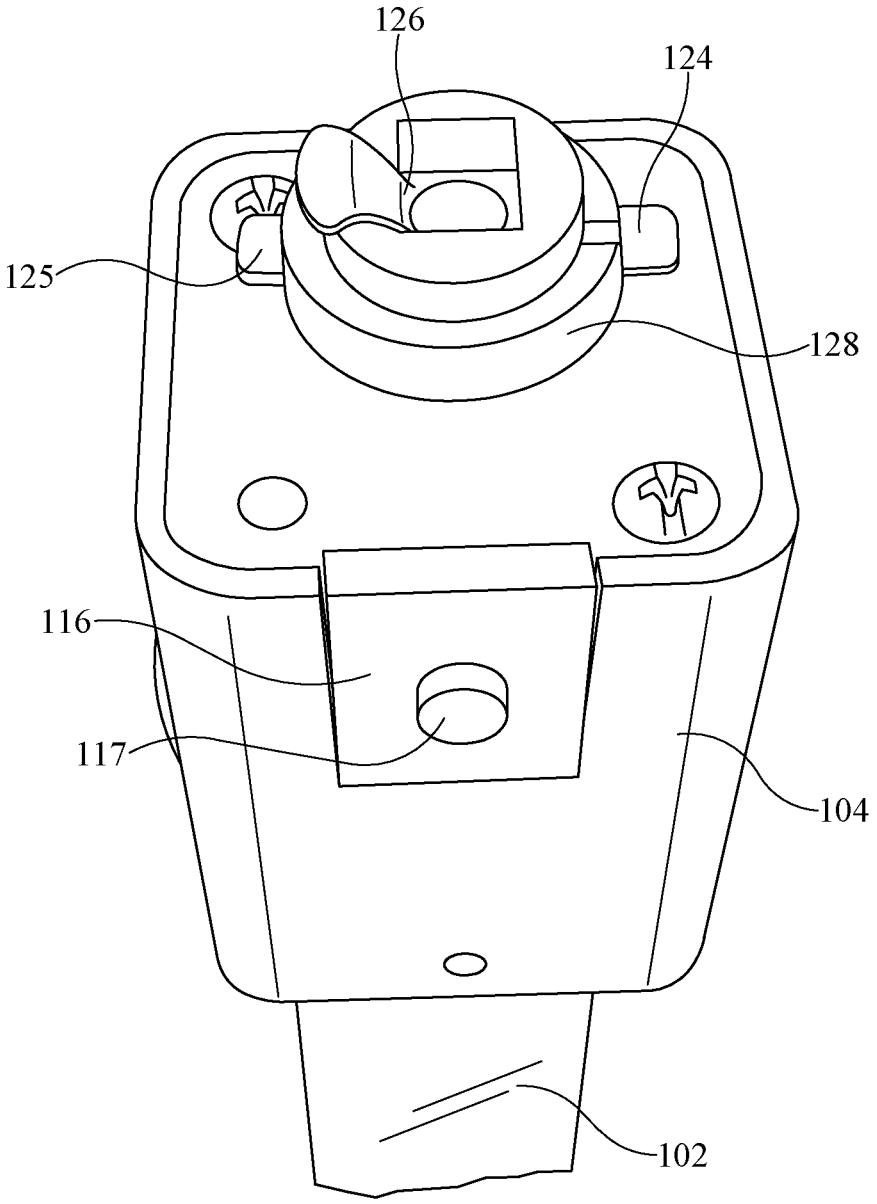
FIG. 6 is an end perspective view of the sole LED lamp holder shown in FIG. 5.

FIGS. 4-6 show a portion of LED lighting system 100 having LED lamp 102 removed from LED lamp mount 106. LED lighting system 100 may have LED lamp mount 106 in the form of a track with slot 108. LED lamp mount 106 may have one or more apertures 107 configured and disposed for mounting LED lamp mount 106. LED lamp holder 104 may be configured to slide within slot 108 and maintain an electrical connection with LED lamp mount 106.

For example, LED lamp holder 104 may comprise a pair of tabs, 124 and 125, extending outward therefrom. Tabs 124 and 125 may have a width less than a width of slot 108 and configured to be received into slot 108. LED lamp holder 104 may be configured to rotate in slot 108 and to cooperate tabs 124 and 125 with portions of LED lamp mount 106 and hold longitudinally extending LED lamp 100 LED lamp mount 106. In this example, LED lamp holder 104 is configured to slide about the longitudinal axis of LED lamp mount 106 upon cooperation of tabs 124 and 125, with portions of LED lamp mount 106. Upon rotation of LED lamp holder 104 and cooperation of tabs 124 and 125 with portions of LED lamp mount 106, locking device 116 may be engaged with LED lamp mount 106 and stop its rotation. For removal of LED lamp 100 from LED lamp mount 106, locking device 116 may be retracted by hand by applying a force, by hand, to protuberance 117 and sliding locking device 116 out of slot 108.

LED lamp holder 104 and LED lamp mount 106 may be configured to electrically connect longitudinally extending LED lamp 100 to a power source, upon rotation and cooperation of tabs 124 and 125 with portions of the track or LED lamp mount 106. For example, LED lamp holder 104 may have first tab 124, second tab 125, and an electrical contact 126 extending from an insulating support 128. LED lamp mount 106 may have one or more electrical contacts, or contact strips 122, disposed therewith. Electrical contact 126 may be configured and disposed to become in electrical contact with contact strip 122 upon a rotation of LED lamp 100 in LED lamp mount 106. First tab 124 and/or second tab 125 may be configured and disposed to also become in electrical contact with LED lamp mount 106, or other electrical contacts in LED lamp mount 106, upon a rotation of LED lamp 100 in LED lamp mount 106.

Figure 7:
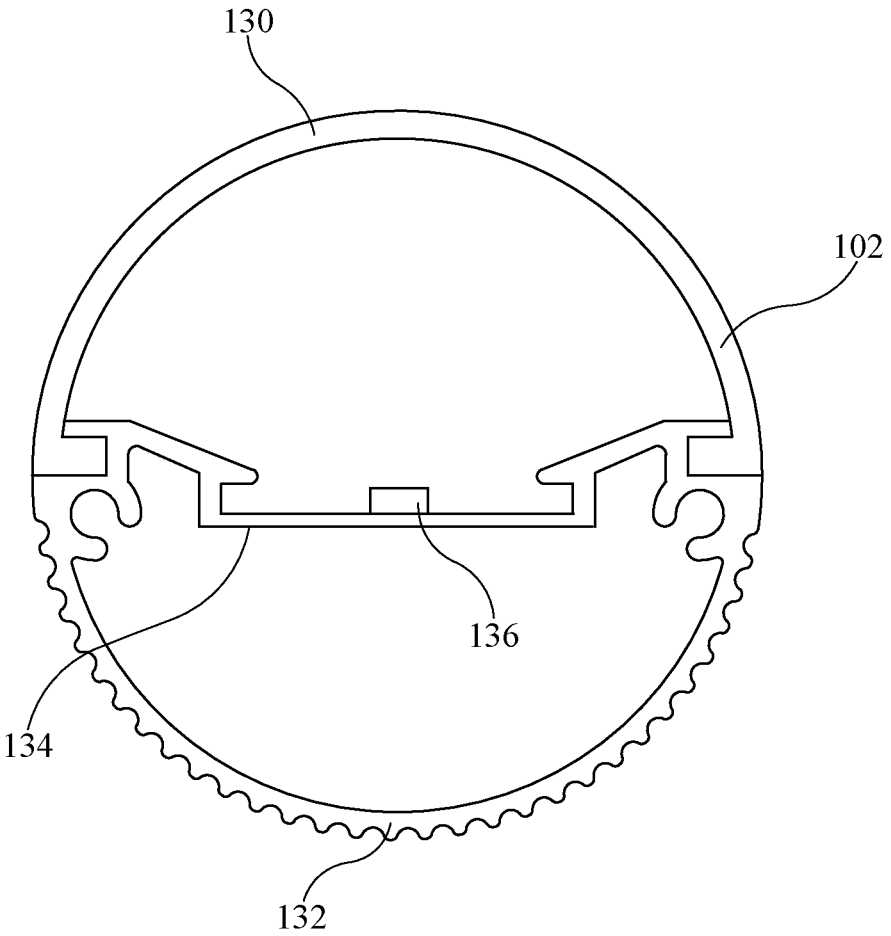
FIG. 7 is a cross-sectional view of the longitudinally extending LED lamp shown in FIG. 1.

FIG. 7 shows a cross-sectional view of a longitudinally extending LED lamp 100. Longitudinally extending LED lamp 100 may have a longitudinally extending diffuser 130 attached with a longitudinally extending heat sink 132. Substrate 134 may longitudinally extend between diffuser 130 and heat sink 132 and hold an array of LEDs 136 on its side proximate diffuser 130.

Figure 8:
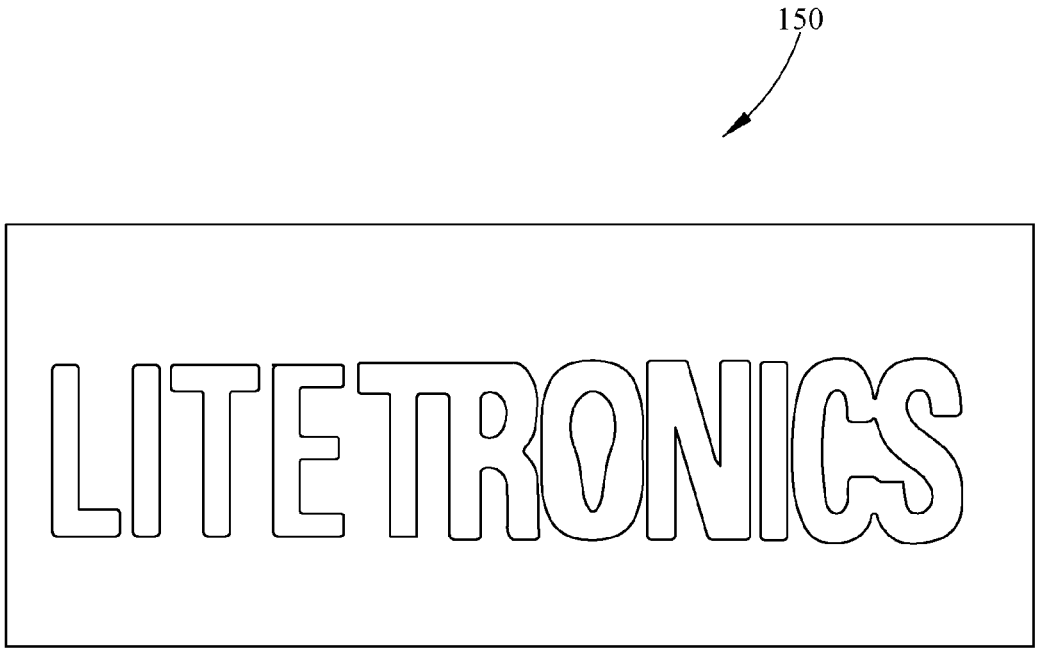
FIG. 8 shows the LED lighting system of the present disclosure used in signage.

FIG. 8 shows the LED lighting system of the present disclosure used in signage. For example, the lighting system of the present disclosure may have sign 150 illuminated. In at least embodiment of the lighting system of the present disclosure, at least one surface of a light transmissive portion of sign 150 is back lit.

A method for installing a lighting system is presently disclosed. The method comprises installing an LED lamp mount 106 proximate or with an item or area to be illuminated. A sole lamp holder, 104 or 204, is connected to LED lamp mount 106 or 206, thereby holding a longitudinally extending LED lamp, 102 or 202, having a length substantially greater than a width, therewith. A portion of sole lamp holder, 104 or 204, may be placed into slot, 108 or 208, in LED lamp mount 106 or 206 and LED lamp holder 104 or 204 may be rotated to hold the longitudinally extending LED lamp, 102 or 202, to LED lamp mount 106 or 206. Rotation of longitudinally extending LED lamp, 102 or 202, may cooperate outward extending tabs, extending outward from sole lamp holder, 104 or 204, with a portion of the LED lamp mount, 106 or 206, and hold the longitudinally extending lamp to the lamp mount. Rotation of longitudinally extending LED lamp, 102 or 202, may cooperate at least one electrical contact 126, on sole lamp holder 104 or 204, with at least one electrical contact 122 on LED lamp mount, 106 or 206, and electrically connect longitudinally extending LED lamp, 102 or 202, with the LED lamp mount, 106 or 206. LED lamp 100 may be rotated about its longitudinal axis to cooperate with LED lamp mount 106.

In at least one embodiment of the presently disclosed LED lighting system, the lighting system comprises at least one longitudinally extending LED lamp having a length substantially greater than a width. A sole LED lamp holder is on each of the at least one longitudinally extending LED lamps. A longitudinally extending track LED lamp mount has a longitudinally extending slot. A locking mechanism is on the sole LED lamp holder and is configured to hold a portion of the LED lamp holder in the slot, upon a rotation of the LED lamp holder. For example, a locking mechanism may comprise two tabs configured and disposed to cooperate with the track LED lamp mount, upon rotation of the sole lamp holder. Optionally, the mechanism may comprise locking device configured to extend into the slot, but is not required.

Electrical contacts may be on the LED lamp holder and on the longitudinally extending track lamp mount, wherein the electrical contacts on the LED lamp holder and on the longitudinally extending track lamp mount are configured and disposed to become in electrical communication upon rotation of the LED lamp holder in the slot. The LED lighting system of the present disclosure may comprise a sign configured and disposed to have at least one surface illuminated with the at least one longitudinally extending LED lamp.

NOMENCLATURE

LED lighting system 100
longitudinally extending LED lamp 102
sole LED lamp holder 104
track LED lamp mount 106
aperture 107
track slot 108
end cap 110
electrical connector with plug receptacle 112
electrical connector 114
locking device 116
protuberance 117
power lead wire 118
quick connect 120
electrical contact strip 122
first tab 124
second tab 125
electrical contact extension 126
insulating support 128
diffuser 130
heat sink 132
substrate 134
array of LEDs 136
sign 150
LED lighting system 200
diffuser 201
longitudinally extending LED lamp 202
heat sink 203
sole LED lamp holder 204
track LED lamp mount 206
track slot 208
end cap 210
lamp base 212
electrical connector 214
magnet 216

The invention claimed is:

1. An LED lighting system comprising:

at least one longitudinally extending LED lamp having a length greater than a width and a longitudinal axis;

a sole LED lamp holder extending from a central portion of the longitudinal axis of each of the at least one longitudinally extending LED lamps;

each of the sole lamp holders being configured to hold the longitudinally extending LED lamp from which the sole lamp holder extends;

an LED lamp mount holding each of the sole LED lamp holders;

the LED lamp mount or the sole lamp holders being configured to energize each of the longitudinally extending LED lamps; and wherein the LED lamp mount is configured for mounting the LED lighting system.

2. The LED lighting system of claim 1 wherein the LED lamp mount has a length greater than a width, the sole LED lamp holder being configured to hold each of the at least one longitudinally extending LED lamps with its longitudinal axis perpendicular with a longitudinal axis of the LED lamp mount.

3. The LED lighting system of claim 1 wherein the LED lamp mount comprises a track with a slot and the LED lamp holder is configured to slide within the slot.

4. The LED lighting system of claim 3 wherein the LED lamp holder comprises a pair of tabs extending outward therefrom, the tabs having a width less than a width of the slot and are configured to be received into the slot, the LED lamp holder being configured to rotate in the slot and to cooperate the tabs with portions of the track and hold the longitudinally extending LED lamp to the track.

5. The LED lighting system of claim 4 wherein the LED lamp holder is configured to slide about the longitudinal axis of the track upon cooperation of the tabs with portions of the track.

6. The LED lighting system of claim 4 wherein the LED lamp holder and the track are configured to electrically connect each of the at least one longitudinally extending LED lamps to a power source, upon cooperation of the tabs with portions of the track.

7. The LED lighting system of claim 4 wherein the LED lamp holder comprises a locking device configured to have a portion received into the slot, upon a 90° rotation of the LED lamp holder in the slot, and stop the rotation of the LED lamp holder.

8. The LED lighting system of claim 7 wherein the portion of the locking device configured to be received into the slot is a retractable extension biased toward the slot and is configured to be retracted from the slot, by hand, and enable the rotation of the LED lamp holder in the slot and removal of the LED lamp from the track.

9. The LED lighting system of 1 wherein each of the at least one longitudinally extending LED lamps has a base configured to electrically connect and be held with its sole LED lamp holder.

10. A method for installing a lighting system comprising the steps of:

installing an LED lamp mount proximate or with an item or area to be illuminated;

connecting at least one sole lamp holder to the LED lamp mount;

holding a longitudinally extending LED lamp, having a length greater than a width, with each of the at least one sole lamp holders, wherein each of the longitudinally extending lamps are held proximate a center of a longitudinal axis of the longitudinally extending LED lamp; and electrically connecting the sole lamp holder with the longitudinally extending LED lamp being held therewith.

11. The method for installing a lighting system of claim 10 wherein the step of connecting a sole lamp holder to the LED lamp mount comprises inserting a portion of the sole lamp holder into a slot in the LED lamp mount and rotating the sole lamp holder.

12. The method for installing a lighting system of claim 11 wherein the step of rotating the longitudinally extending LED lamp comprises cooperating outward extending tabs, extending outward from the sole lamp holder, with a portion of the LED lamp mount.

13. The method for installing a lighting system of claim 11 wherein the step of rotating the LED lamp comprises cooperating at least one electrical contact on the sole LED lamp holder with at least one electrical contact on the LED lamp mount and electrically connecting the longitudinally extending LED lamp with the LED lamp mount.

14. An LED lighting system comprising:

at least one longitudinally extending LED lamp having a length greater than a width and a longitudinal axis;

an LED lamp holder on a central portion of each of the at least one longitudinally extending LED lamps, the LED lamp holder being configured to hold and energize the longitudinally extending LED lamp;

an LED lamp mount holding each of the LED lamp holders;

the LED lamp mount or the LED lamp holders being configured to energize each of the at least one longitudinally extending LED lamps; and the LED lamp mount being configured to mount each of the LED lamp holders.

15. The LED lighting system of claim 14 further comprising electrical contacts on the LED lamp holder and on the lamp mount, wherein the electrical contacts on the LED lamp holder and on the LED lamp mount are configured and disposed to become in electrical communication with each other.

16. The LED lighting system of claim 1, wherein the LED lamp mount is configured to electrically connect with a power supply and each of the at least one sole LED lamp holder.

17. The method for installing a lighting system of claim 10, further comprising a step of electrically connecting the LED lamp mount with a power supply.

18. The LED lighting system of claim 14, wherein the LED lamp mount is configured to electrically connect with a power supply and each of the at least one LED lamp holder.

* * * * *